United States Patent [19]

Woodruff et al.

[11] 4,369,158

[45] Jan. 18, 1983

[54] STICK ANTIPERSPIRANT PACKAGE AND PROCESS

[75] Inventors: Keith Woodruff, Mountainside, N.J.; Donald Johnson, Flushing, N.Y.; John H. Hill, East Rutherford; Barbara A. Donovan, Clifton, both of N.J.

[73] Assignee: American Cyanamid Company, Stamford, Conn.

[21] Appl. No.: 144,083

[22] Filed: Apr. 28, 1980

[51] Int. Cl.[3] ..... B65B 37/00; B29C 5/00

[52] U.S. Cl. ..... 264/268; 264/279; 264/299; 401/175; 425/812

[58] Field of Search ..... 264/261, 267, 268, 271.1, 264/279, 299; 206/581; 425/803, 812; 53/410, 319, 440, 471, 489, 485; 401/192, 175

[56] References Cited

U.S. PATENT DOCUMENTS 3,008,172 11/1961 Thompson ..... 401/175
4,298,036 11/1981 Horvath ..... 53/489

FOREIGN PATENT DOCUMENTS 2807472 8/1979 Fed. Rep. of Germany ..... 401/175

*Primary Examiner*—Willard E. Hoag
*Attorney, Agent, or Firm*—Charles J. Fickey

[57] ABSTRACT

Method for making a package for a wax-like cosmetic stick product having a twist-up in the bottom of the package, the twist-up comprising a base, spindle and elevator, vents in both said base and elevator, and a cap affixed to the package.

5 Claims, 14 Drawing Figures

STICK ANTIPERSPIRANT PACKAGE AND PROCESS

This invention relates to a method for the manufacture of a solid, low melting, wax-like cosmetic or pharmaceutical stick in a twist-up type package. More particularly, it relates to an improved method for increasing the bonding strength between a plastic twist-up and the solid or semi-solid stick composition.

Most cosmetic sticks, including deodorant and antiperspirant compositions, comprise a solid, waxy, low melting formulation containing an active ingredient, where applicable, encased in a suitable container provided with a means for pushing the stick upwards through the container to expose more surfaces as the stick is consumed. Heretofore, as far as we are aware, these sticks, particularly deodorant and antiperspirant sticks, have been fabricated by pouring the molten composition into the top of a suitable container equipped with a suitable twist-up device inserted into the bottom thereof. In so doing, a pouring cup, open at the top, or pouring device, is first attached to the top of the container in a removable manner.

The method described results in a product having a number of disadvantages. A top surface is formed on the stick which is substantially perpendicular to the longitudinal axis of the stick, thereby forming a squared edge. When this edge is applied to a surface, it results in crumbling, with resultant loss of material until a rounded edge finally forms. In addition, during cooling and solidification of the stick material is poured in the container, the top surface contracts leaving air voids creating an unfavorable effect esthetically in the mind of the user.

It has also been proposed to form such an antiperspirant stick by a process in which the container is first fitted with a pouring cap, inverted and filled with the molten material through the open bottom of the container. Before the molten material is cooled, a twist-up device was inserted through the bottom of the container to contact the basic of the solid cosmetic stick, the pouring cap was removed, and a regular package cap fitted to the container. Although this process formed a uniform shaped top to the cosmetic stick, it did not produce a firm bond between the base of the stick and the twist-up. The result was that the stick often separated from the twist-up and fell out of the container. In addition, large voids or shrink holes were formed in the base of the stick, depressions formed on the outer surface of the stick.

The present invention is an improvement over the prior process, whereby the bond strength between the push-up and the stick composition is improved; the shrink hole and air bubble formation are reduced; better control on the insertion of the housing component to be bonded with the stick is obtained; better control of the state of the stick prior to and during insertion is obtained; there is increased manufacturing speed; and minimization of the effects of line breakdowns and variability of product are achieved.

The invention may be better understood by reference to the drawings in which.

Figure 14:
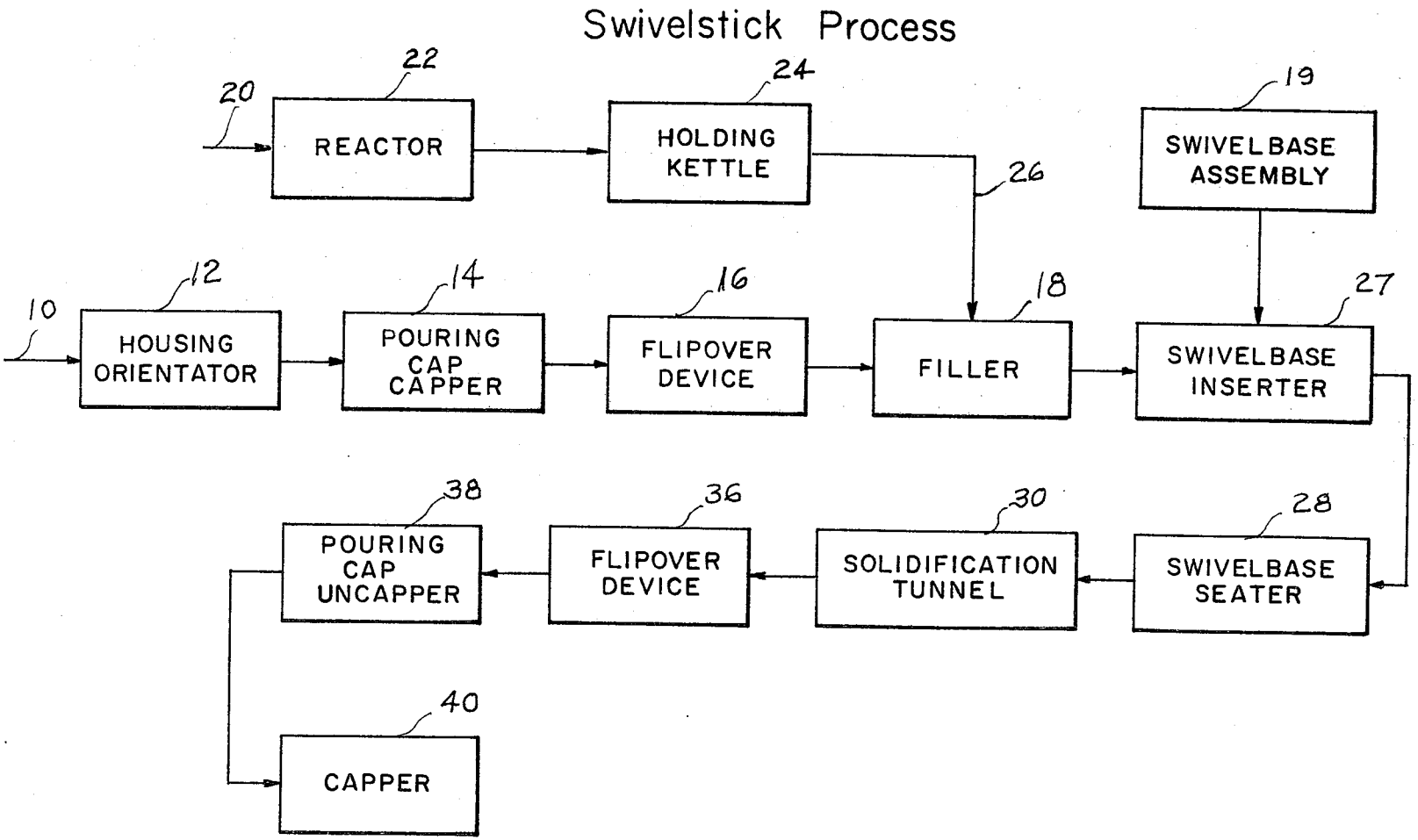
FIG. 14 is a flow diagram of the process of the invention.

With reference to the flow sheet of FIG. 14, a reactor 22 is charged via line 20 with the ingredients to prepare the cosmetic stick formulation, which is then held until needed in a heated holding kettle 24.

Figure 1:
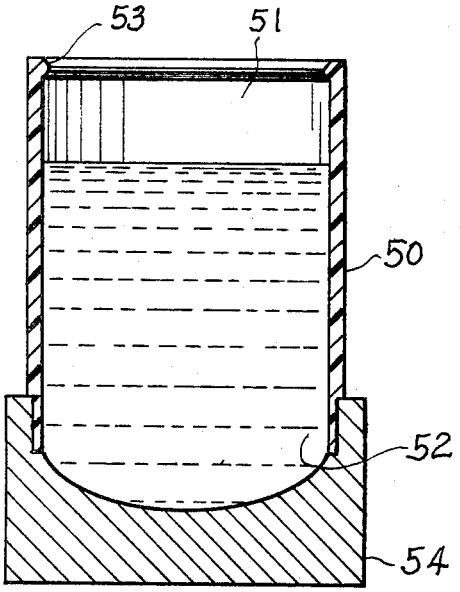
FIG. 1 is a cross-section view in elevation of a container and pouring head filled with molten fill material.

In a continuous manner a housing orientator 12 aligns the container bodies or housings 50 (See FIG. 1), which are generally open at both top 52 and bottom 51 with a flange 53 adjacent the bottom opening, in an upright position on a conveyor belt 10. Container housing 50 then moves to a pouring cap affixing or capping device 14 which affixes onto the top of the housing a pouring cap 54, which closes the top end of the container housing. The interior surface of pouring cap 54 is shaped to form a custom upper surface of the stick. A premeasured quantity of the molten formulation from holding kettle 24 at a temperature of about 53° C. is then added to container 50 through the bottom opening 51 by filling device 18 via line 26.

Figure 9:
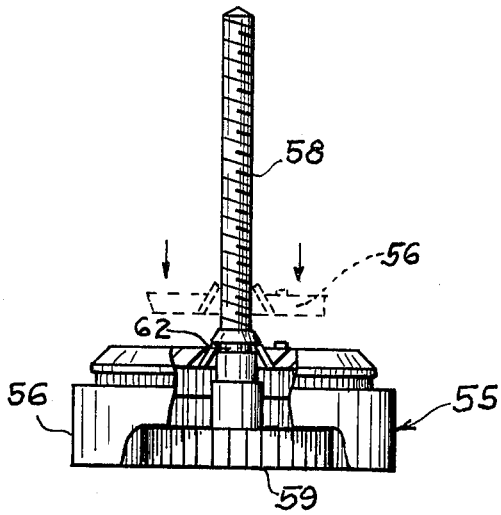
FIG. 9 is an elevational view of the base and spindle assembly.
Figure 10:
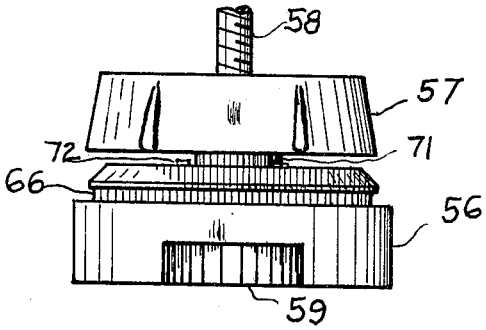
FIG. 10 is the assembly of FIG. 9 with the elevator threaded onto the spindle.

Immediately after the molten material has been filled in case 50 (i.e. within about one minute), a twist-up assembly 55 preassembled at 19 (see FIG. 9) is inserted into at bottom opening 51 (see FIG. 2) by inserter 27 while the fill material is still molten. Twist-up assembly 55 consists of base platform 56, elevator 57 and spindle 58 with knob 59. Spindle 58 fits through opening 60 of base 56 and is held in place by yieldable tabs 61 which fit into annular groove 62 on the shaft of spindle 58. Elevator 57 has a threaded central opening 63 which fits onto threaded spindle 58. Both base 56 and elevator 57 have ventilation openings 64 and 65 respectively for passage of air. This is necessary so that the trapped air may escape from case 50 when the twist-up assembly 55 is inserted, to prevent formation of voids in the fill material after solidification. In addition, as the fill material begins to solidify, an internal vacuum develops and the vent holes provide for the reentry of air to relieve this to prevent dimple formation on the solidified stick surface next to the inner surface of case 50.

Spindle assembly 55 is inserted slowly at a controlled rate at low pressure by seater 29 to prevent splashing of molten material, and sealing of vent holes 65 in elevator 57 and prevent proper circulation of air. Base 56 has an annular groove 66 into which flange 53 of case 50 locks, to hold the twist-up assembly 55 in case 50. Container 50 then traverses a solidification zone or tunnel 30 whereby it solidifies to form the stick product.

Figure 2:
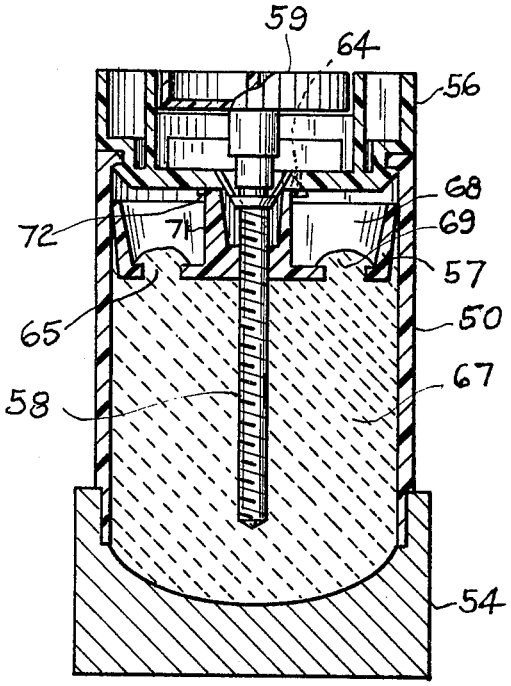
FIG. 2 is the container of FIG. 1 with a twist-up assembly inserted and the fill material solidified.
Figure 3:
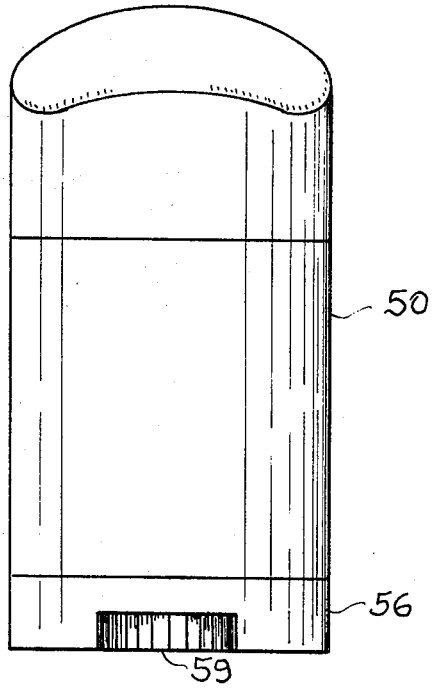
FIG. 3 is a front elevational view of the package and cap.
Figure 11:
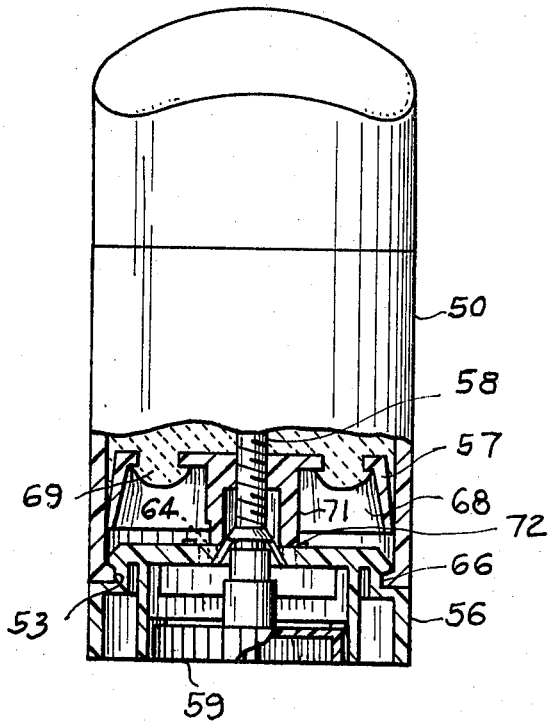
FIG. 11 is a front view in elevation of the package and cap with parts broken away to show the base and spindle assembly in the container after filling and solidification.
Figure 13:
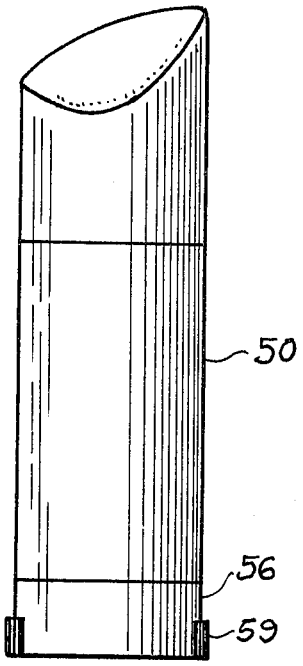
FIG. 13 is a side view in elevation of the package with cap.
Figure 4:
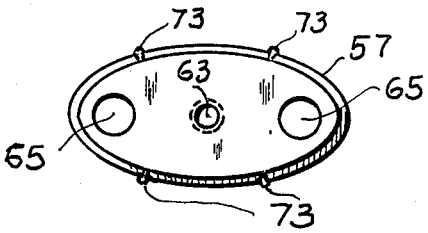
FIGS. 4, 5 and 6 are respectively top, cross-sectional and bottom views of the elevator of the container.
Figure 12:
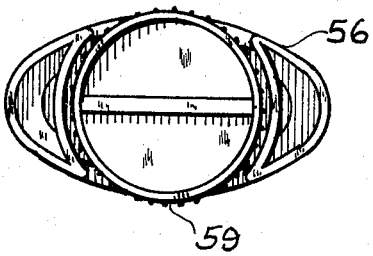
FIG. 12 is a bottom plan view of the package with cap.
Figure 5:
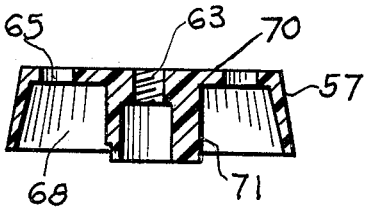
Figure 6:
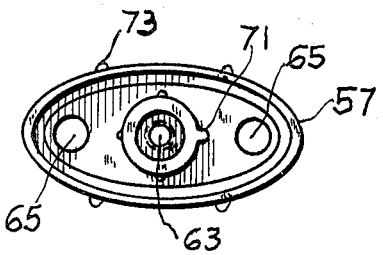
Figure 7:
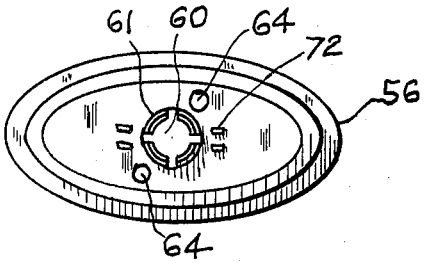
FIGS. 7 and 8 are respectively top and elevational views of the container base.
Figure 8:
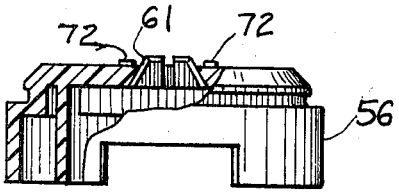

Solidification tunnel 30 consists of a conditioning zone held at a temperature of about 35° to 45° C. and a cooling belt at room temperature. The time in conditioning is at least 12 minutes and at least an equal time on the cooling belt. This allows sufficient time for the molten material to solidify to form a stick 67 as shown in FIG. 2, and for removal of pouring cap 54 without tearing off part of the stick. Moreover, it has been found that large shrink holes develope around spindle 58 unless sufficient cooling time is allowed and proper circulation of air is provided for as described above. After solidification, container 50 is then inverted by a flipover device 36 and then travels to an uncapping device 38 which removes pouring cap 54 from the top of container 50. Finally, the container is capped by the capper device 40.

The shape of the top surface of the stick will depend on the design of the mold inserted into the pouring cap. Such designs may include lettering etched into the mold surface to depict the product name or company logo, and the like. Moreover, the mold may provide a tapered edge to the top edge of the stick whereby crumbling of the stick is prevented during use.

The container package of the invention is particularly useful for the preparation of deodorant and antiperspirant sticks, but may be used effectively for other cosmetic or pharmaceutical formulations in stick form.

In order to show the advantages of the package and process a comparison was made of cosmetic sticks formed under differing conditions, wherein the product ingredients were identical. The formulation was as follows:

| | Parts by Weight |
|---|---|
| Ethoxylated Stearyl Alcohol | 1.0 |
| Stearyl Alcohol (95%) | 20.0 |
| Aluminum chlorhydrate | 25.0 |
| Cyclic Silicone Pentamer | 53.4 |
| Fragrance | 0.6 |
| | 100.0 |

The bond strength is greatly increased and the void space is reduced by the use of the present package, and process as shown in Table 1.

TABLE 1

| | Run 1 | Run 2 |
|---|---|---|
| Retractability | 72.5% | 20.0% |
| Zero Retractability | 25.5% | 80.0% |
| Dimples | 2.9% | 40.0% |
| Average Bond Strength | 227.4 gms | Less than 50 gms |
| Zero Bond | 7.1% | 80.0% |
| Average Hole Size | 0.7 $cm^3$ | Excessively large |
| Zero Hole | 2.1% | 0% |
| Head Rip Off | 0% | 20.0% |

Run 1 Slow insertion of vented twist-up. Slow cooling and removal of pouring head. Run 2 Short cooling and removal of pouring head. Rapid insertion of twist-up. No venting.

Bottom filling in the package of the invention also compensates for uneven filling. Thus it is not necessary to have as precise measuring of the quantity since the cavity 68 below elevator 57 will allow for excess molten stick material.

As seen at 69 (FIG. 2), elevator 57 is pushed into the molten material so that the material exudes through air holes 65. After solidification, the material locks the stick 67 more firmly to elevator 57. An additional lip, not shown, may be provided around the periphery of the upper surface 70 of elevator 57 to provide additional bonding for stick 67.

In addition, a key 71 is provided on the lower side of elevator 57 which fits into a pair of stops 72 on either side of the upper surface of base 56. This prevents turning of spindle 58 when in a fully retracted position and stripping the threaded fit between solid stick 67 and the spindle. Nibs 73 have been provided on the sides of elevator 57 to maintain continuous contact with the inner surface of case 50. This prevents separation of the stick from the elevator during retraction after the stick has been turned up for use, due to translated torque.

The present process and package make it possible to produce a stick which is homogeneous, free of voids and dimples and has excellent bonding to the elevator in a twist-up, non-symetrical package. In addition, since container 50 and base 56 are separable, the fill product weight may be varied by changing the height of container 50. Any height of the container will still fit the same base 56.

We claim:

1. A process for the manufacture of a solid, wax-like cosmetic or pharmaceutical stick product, which comprises the steps of attaching a pouring cap closure to the upper portion of a suitable container for said stick, said container being open at the bottom; inverting said container body and filling from the bottom thereof with a premeasured quantity of said cosmetic or pharmaceutical composition in a molten state; there inserting into the bottom portion of said container body, a twist-up device having air vents, twist-up device comprising a base, spindle and elevator, venting air through said vents cooling said composition for sufficient time to form within said container a solid, wax-like stick, reinverting the container and removing said pouring cap.

2. The process according to claim 1 wherein said container is a non-symmetrical body adapted on the upper portion to receive a cap and having a flange incorporated in the bottom as a seat for said twist-up device.

3. The process of claim 2 wherein said twist-up comprises a base, spindle and elevator, both said base and elevator having air vents.

4. The process of claim 3 wherein said elevator has means to maintain continuous contact with the inner surface of said container as said elevator is raised or lowered.

5. The process of claim 3 wherein said elevator and base have means to lock said spindle from rotation when in a fully retracted position.

* * * * *